US011350747B2

(12) United States Patent
Poppenborg

(10) Patent No.: US 11,350,747 B2
(45) **Date of Patent: *Jun. 7, 2022**

(54) CONSTRUCTION PANEL FOR A SIDE OF AN ITEM OF FURNITURE, METHOD FOR PRODUCING SAID TYPE OF CONSTRUCTION PANEL AND SIDE OF AN ITEM OF FURNITURE AND FURNITURE BODY OR ITEM OF FURNITURE HAVING A SIDE

(71) Applicant: AMBIGENCE GMBH & CO. KG, Herford (DE)

(72) Inventor: Norbert Poppenborg, Bad Salzuflen (DE)

(73) Assignee: AMBIGENCE GMBH & CO. KG, Herford (DE)

( * ) Notice: Subject to any disclaimer, the term of this patent is extended or adjusted under 35 U.S.C. 154(b) by 40 days.

This patent is subject to a terminal disclaimer.

(21) Appl. No.: 16/489,180

(22) PCT Filed: Feb. 23, 2018

(86) PCT No.: PCT/EP2018/054528
§ 371 (c)(1),
(2) Date: Aug. 27, 2019

(87) PCT Pub. No.: WO2018/158151
PCT Pub. Date: Sep. 7, 2018

(65) Prior Publication Data

US 2019/0380496 A1 Dec. 19, 2019

(30) Foreign Application Priority Data

Feb. 28, 2017 (DE) ..... 10 2017 104 185.0

(51) Int. Cl.
*A47B 96/20* (2006.01)
*E05D 15/46* (2006.01)
*E05D 15/26* (2006.01)

(52) U.S. Cl.
CPC ..... *A47B 96/206* (2013.01); *A47B 96/205* (2013.01); *E05D 15/262* (2013.01);
(Continued)

(58) Field of Classification Search
CPC ..... A47B 96/206; E05D 15/262; E05D 15/46; E05Y 2900/20; E05Y 2600/452
See application file for complete search history.

(56) References Cited

U.S. PATENT DOCUMENTS 4,185,357 A 1/1980 Busse
4,365,454 A 12/1982 Davis
(Continued)

FOREIGN PATENT DOCUMENTS

AU 2010247643 A1 11/2011
CN 102159378 A 8/2011
(Continued)

OTHER PUBLICATIONS

International Search Report dated Aug. 22, 2018 in related/corresponding International Application No. PCT/EP2018/054528.
(Continued)

*Primary Examiner* — Kimberley S Wright
(74) *Attorney, Agent, or Firm* — Patent Portfolio Builders PLLC

(57) ABSTRACT

A construction panel for a side of an item of furniture of a furniture body includes a plate-shaped central part having a first front surface and other front surfaces, and a cut-out arranged in the central part. The cut-out extends at least along one section of the first front surface of the construction panel and is used to accommodate a stop that guides a
(Continued)

moveable furniture part. The construction panel includes, in the region of at least one of the additional front surfaces, at least one machinable section that is outside of the cut-out.

31 Claims, 11 Drawing Sheets

(52) U.S. Cl.
CPC ..... *E05D 15/46* (2013.01); *E05Y 2201/10* (2013.01); *E05Y 2600/41* (2013.01); *E05Y 2600/452* (2013.01); *E05Y 2900/20* (2013.01)

(56) References Cited

U.S. PATENT DOCUMENTS

| | | | | |
|---|---|---|---|---|
| 6,286,198 | B1 | 9/2001 | Riesmeier | |
| 7,540,577 | B2 | 6/2009 | Netzer | |
| 10,722,031 | B2 * | 7/2020 | Sobolewski | A47B 96/04 |
| 10,820,701 | B2 * | 11/2020 | Sobolewski | A47B 96/205 |
| 10,881,207 | B2 * | 1/2021 | Sobolewski | E05D 3/06 |
| 2011/0006651 | A1 * | 1/2011 | Leng | A47B 47/042 312/265.5 |
| 2015/0351542 | A1 * | 12/2015 | Chen | B32B 21/042 428/138 |
| 2019/0166992 | A1 | 6/2019 | Held | |
| 2019/0380494 | A1 * | 12/2019 | Sobolewski | F16B 12/14 |
| 2019/0380495 | A1 * | 12/2019 | Sobolewski | A47B 96/205 |
| 2020/0008578 | A1 * | 1/2020 | Sobolewski | E05D 3/06 |
| 2020/0060422 | A1 * | 2/2020 | Sobolewski | E05F 1/1041 |

FOREIGN PATENT DOCUMENTS

| | | | | | |
|---|---|---|---|---|---|
| CN | 102548451 | A | | 7/2012 | |
| CN | 105507493 | A | * | 4/2016 | |
| CN | 105507493 | A | | 4/2016 | |
| DE | 1559963 | A1 | | 12/1969 | |
| DE | 2723850 | A1 | | 11/1978 | |
| DE | 102007011037 | A1 | | 10/2007 | |
| DE | 202013003189 | U1 | | 7/2014 | |
| DE | 102015113427 | A1 | | 2/2017 | |
| DE | 202017101255 | U1 | * | 4/2018 | E05D 15/40 |
| FR | 3023331 | A1 | | 1/2016 | |
| JP | S57112818 | A | | 7/1982 | |
| JP | 2000157362 | A | | 6/2000 | |
| JP | 2012526573 | A | | 11/2012 | |
| WO | WO-2010130570 | A1 | * | 11/2010 | A47B 51/00 |
| WO | 2017121678 | A1 | | 7/2017 | |

OTHER PUBLICATIONS

Written Opinion dated Aug. 22, 2018 in related/corresponding International Application No. PCT/EP2018/054528.

Search Report created on Aug. 28, 2019 in related/corresponding DE Application No. 10 2017 104 185.0 (references from Search Report not cited herewith have previously been made of record).

Translation of Office Action dated Dec. 3, 2020 in related/corresponding CN Application No. 201880014638.7.

Office Action dated Jan. 18, 2022 in related/corresponding JP Application No. 2019-547418.

* cited by examiner

CONSTRUCTION PANEL FOR A SIDE OF AN ITEM OF FURNITURE, METHOD FOR PRODUCING SAID TYPE OF CONSTRUCTION PANEL AND SIDE OF AN ITEM OF FURNITURE AND FURNITURE BODY OR ITEM OF FURNITURE HAVING A SIDE

BACKGROUND AND SUMMARY OF THE INVENTION

Exemplary embodiments of the invention relate to a construction panel for a furniture wall of a furniture body having a plate-shaped core, which comprises a first end face and further end faces, wherein a recess is arranged in the core that extends at least along a portion of the first end face of the construction panel and is used to accommodate a fitting which guides a movable furniture part. Exemplary embodiments of the invention also relate to a method for producing such a construction panel and a furniture wall and a furniture body or an item of furniture having such a furniture wall.

Items of furniture, in particular kitchen furniture such as top, bottom, or hanging cabinets, generally have a furniture body open toward the front, on which furniture parts movably guided via one or more fittings are installed. The movably guided furniture parts can be drawers having a drawer front panel or doors or flaps, which can be used individually or in different combinations in a furniture body. The present application relates in particular to the use of doors and flaps as movable furniture parts. Doors and flaps are differentiated in the scope of this application on the basis of the alignment of the pivot axis, which extends vertically in the case of doors and horizontally in the case of flaps.

The doors and flaps can be in one piece or can consist of multiple individual parts in this case, for example, a folding flap, in which various parts of the flap move in relation to one another in the movement sequence.

Door hinges, which are arranged on the side of the pivot axis between furniture body and door, are generally used for guiding doors. A comparable arrangement of hinges can also be used in principle in the case of flaps. These hinges are then arranged along an upper side edge of the flap. However, it is frequently desirable to open the flaps in a combined pivoting and sliding movement, for example, in the case of a hanging cabinet, to obtain the greatest possible access to the cabinet interior without the flap having to be pivoted up in a horizontal position, in which it is reachable not at all or only poorly by the user for closing. For this reason, special flap fittings have become established, which are not arranged along the pivot axis between the furniture body and the flap, but rather laterally on (in general both) side edges between the flap and the side wall of the furniture body.

Such door hinges or flap fittings for installation on an inner side of the side wall or the side walls of the furniture body are known. The fittings unavoidably protrude into the interior of the furniture body in this case, however, which reduces the usable storage space inside the furniture body, on the one hand, and also impairs a structuring of the interior of the furniture body, on the other hand. Cleaning of the interior, in particular the inner side of the side wall of the furniture body, is also obstructed by the installed fittings. Thus, a side wall on which no fittings are installed is desirable for visual reasons.

It is known to install door hinges by milling a pocket into an end face of a side wall, into which the door hinge is insertable from the front. The inner side of the side wall remains free in this manner. A hinge suitable for use in such a milled pocket is known, for example, from the document DE 1559963.

To use such a hinge, the mentioned milling is performed from the end face of a furniture wall, in particular side wall, already prepared for the furniture body. However, this procedure is only suitable for door hinges having a very small installation depth. This is because of the restricted milling depth, with which such a pocket can be milled from the end face into the side wall cost-effectively in the production process. The installation thickness of the door hinge inserted into such a milled pocket is also very limited, since side walls in the furniture field have a wall thickness of only 16-20 mm (millimeters). During the milling procedure, a certain minimum wall thickness has to remain laterally to the milled-out pockets, since an excessively thin wall would already crack or break in the milling procedure or would become so deformed that it no longer has a flawless surface.

The use of larger and more complex door hinges is already not possible in this manner. Flap hinges generally have a large installation depth in the range of more than 10 or 15 cm (centimeters), which is not to be achieved by milling from the end face.

A side wall for a furniture body is known from the document DE 20 2013 003 189 U1, which consists in portions of different parts. In particular, a rear part facing away from the furniture front is conventionally formed, for example, by a coated wood element. A front part of the side wall is formed by a housing not described in greater detail in the cited document, which comprises a frontal opening into which a fitting can be inserted. The housing is connected, for example, via dowels or screws to the conventional part of the side wall. Since the housing can be provided with thinner housing walls than is possible by way of milling and also enables greater installation depths, this housing can also be used to accommodate larger door hinges or a flap fitting. The surface appearance and haptics of the housing will generally not correspond precisely to that of the conventional part of the side wall, however, so that a uniform surface of the side wall cannot be obtained. Moreover, a transition between the two housing parts will be visible and possibly also perceptible.

Exemplary embodiments of the present invention are directed to an item of furniture or furniture body that can be equipped easily with, for example, a fitting having a greater installation depth and nonetheless can be manufactured with low production expenditure. Moreover, the furniture body is to be distinguished by a uniform surface quality both on its outer side and on its inner side. Exemplary embodiments are also directed to a construction panel for a furniture wall of such a furniture body, using which simple production of the body is possible. Finally, exemplary embodiments are further directed to a method for producing such a construction panel and a furniture wall.

A construction panel according to the invention is distinguished in that it comprises, in the region of at least one of the further end faces, at least one machinable portion, which is located outside the recess. The construction panel prepared for the fitting or already comprising it can be processed like a typical material panel within the machinable portion, for example, cut to length, to manufacture a furniture wall for a furniture body. Using a few and above all conventional processing steps, a furniture body can be manufactured which is provided with fittings accommodated elegantly in the furniture wall. Fittings having a large installation depth can also be used, if they are already integrated into the construction panel during the production thereof.

In one advantageous embodiment of the construction panel, the core is arranged between two laterally applied cover layers. The fitting is preferably accommodated in the recess. The construction panel is then a composite element made of a core and cover layers, wherein according to the invention, the recess required for accommodating the fitting is already introduced into the core during the production of the construction panel before the cover layers are applied. There are thus no restrictions for the size of the recess, as exist in the case of an introduction of the recess for the fitting in a construction panel already provided with cover layers. Large fittings occupying, for example, the entire width or approximately the entire width of the later furniture wall in their depth can thus also be used. At the same time, the construction panel has a preferably one-piece, continuous cover layer on each of the two lateral faces.

In a further advantageous embodiment of the construction panel, the fitting comprises a housing wall and is, for example, screwed together and/or clamped and/or adhesively bonded to the core using this housing wall, preferably before the cover layers are applied. A construction panel for a furniture body having a permanently integrated fitting thus results, whereby the production of the furniture body is simplified.

In a further advantageous embodiment of the construction panel, the core is formed from two core halves, which abut one another in a plane parallel to lateral faces of the construction panel.

The fitting is preferably connected to the core halves and/or at least one of the cover layers, to be able to relay forces acting thereon as safely as possible to the construction panel. For example, for the connection of at least one of the core halves along its edge, the respective recess can have a reduced thickness in such a manner that a shoulder surface is formed toward the recess, on which the fitting rests with at least one tab protruding beyond its edge. Preferably, in this case at least one staple is extended from the at least one tab, which is pressed into the material of at least one core half in the region of the shoulder surface. This represents a particularly simple type of connection in the production process of the wall to connect the fitting to the core. Alternatively or additionally, the fitting can be adhesively bonded (glued) to the core and/or at least one of the two cover layers.

In a further advantageous embodiment of the construction panel, the fitting comprises two housing outer walls, the maximum spacing of which is less than the thickness of the core, so that the fitting is accommodated in the construction panel, without standing out externally on the cover layers. An installation width is available for the fitting corresponding, at maximum, to the thickness of the core. Fittings, the width of which is up to approximately 20 mm, can thus also be used in a construction panel in typical thickness of furniture walls.

In a further advantageous embodiment of the construction panel, the fitting comprises a lever mechanism that guides the movable furniture part. In the closed state of the movable furniture part, the lever mechanism is preferably located between the cover layers. The fitting is then integrated completely into the furniture body in such a way that—unavoidably—only the lever mechanism is visible, and it is also only visible in the open state of the movable furniture part.

In a further advantageous embodiment of the construction panel, it comprises an integrated data carrier, in which items of information on the construction panel and/or an integrated fitting are stored. Moreover, it preferably comprises an integrated transponder, for example, an RFID transponder, which comprises the data carrier and can be read out wirelessly. At a furniture producer, it can thus be ensured by a readout, for example, directly at a machine tool, that the correct type of construction panel is supplied for an item of furniture to be produced.

In a further advantageous embodiment of the construction panel, a position of the at least one machinable portion is marked, for example, on a removable protective film. A position of an integrated transponder can also be marked on the removable protective film to prevent incorrect processing.

In a further advantageous embodiment of the construction panel, a wall hanger is integrated, which can be installed for large-area force transmission to the fitting.

In a further advantageous embodiment of the construction panel, a narrow side coating, for example, an edge veneer, is applied to at least one of the end faces of both core halves and/or of the core. It can extend in one or multiple parts over the entire length of the end face. The edge band is preferably only applied in the region of the front end face of the core when the fitting is integrated and/or inserted, wherein the edge band is arranged at least in portions on the fitting. In this manner, for example, the edges of the side plates of the fitting can be covered.

In a further advantageous embodiment of the construction panel, the fitting comprises a lever mechanism, which guides the movable furniture part. In the closed state of the movable furniture part, the lever mechanism is preferably located between the cover layers. The fitting is then completely integrated into the construction panel in such a way that—unavoidably—only the lever mechanism is visible, and it is also only visible in the open state of the movable furniture part.

A method according to the invention for producing a construction panel comprises the following steps: providing a plate-shaped core and introducing a recess into the core, the recess extending at least along a portion of a first end face of the core, wherein at least one protruding machinable portion remains on at least one further end face of the core outside the recess. Furthermore, at least one lateral cover layer is applied to the core—before or after the introduction of the recess. A fitting is arranged in the recess before or after the application of the lateral cover layer. The advantages mentioned in conjunction with the construction panel result.

In one advantageous embodiment of the method, in a further step, the at least one protruding machinable portion is marked so it is externally recognizable. A protective film is preferably applied for this purpose, on which the at least one machinable portion is marked.

In a further advantageous embodiment of the method, a narrow side coating is applied to the first end face before the insertion of the fitting into the recess, wherein the narrow side coating covers at least parts of the end face of a housing wall of the fitting.

A method according to the invention for producing a furniture wall is distinguished by machining processing, in particular cutting to length of a construction panel having an integrated fitting in at least one machinable portion. In this manner, with low production expenditure having few and above all conventional processing steps, a furniture body can be manufactured that is provided with fittings accommodated elegantly in the furniture wall. Fittings having a large installation depth can also be used if they are already integrated into the construction panels used during the production of the furniture body.

BRIEF DESCRIPTION OF THE DRAWING FIGURES

The invention will be explained in greater detail hereafter on the basis of exemplary embodiments with the aid of figures. In the figures:

FIG. 1 shows a first exemplary embodiment of an item of furniture having a side wall produced from a construction panel according to the application;

FIGS. 2*a*, 2*b* show a second exemplary embodiment of an item of furniture having a side wall produced from a construction panel according to the application in two different open positions of a flap;

FIGS. 3*a*, 3*b* show a third exemplary embodiment of an item of furniture having a side wall produced from a construction panel according to the application in two different open positions of a flap;

FIG. 4 shows a fourth exemplary embodiment of an item of furniture having a side wall produced from a construction panel according to the application;

FIG. 5*a* shows a first exemplary embodiment of a construction panel for a furniture wall in a schematic exploded view;

FIG. 5*b* shows a detail of the construction panel of FIG. 5*a* in an assembled state in a schematic section in the region of the edge of the inserted fitting;

FIG. 5*c* shows a detail of a frontal view of an end face of the construction panel of FIG. 5*a* having inserted fitting;

DETAILED DESCRIPTION

Figure 1:
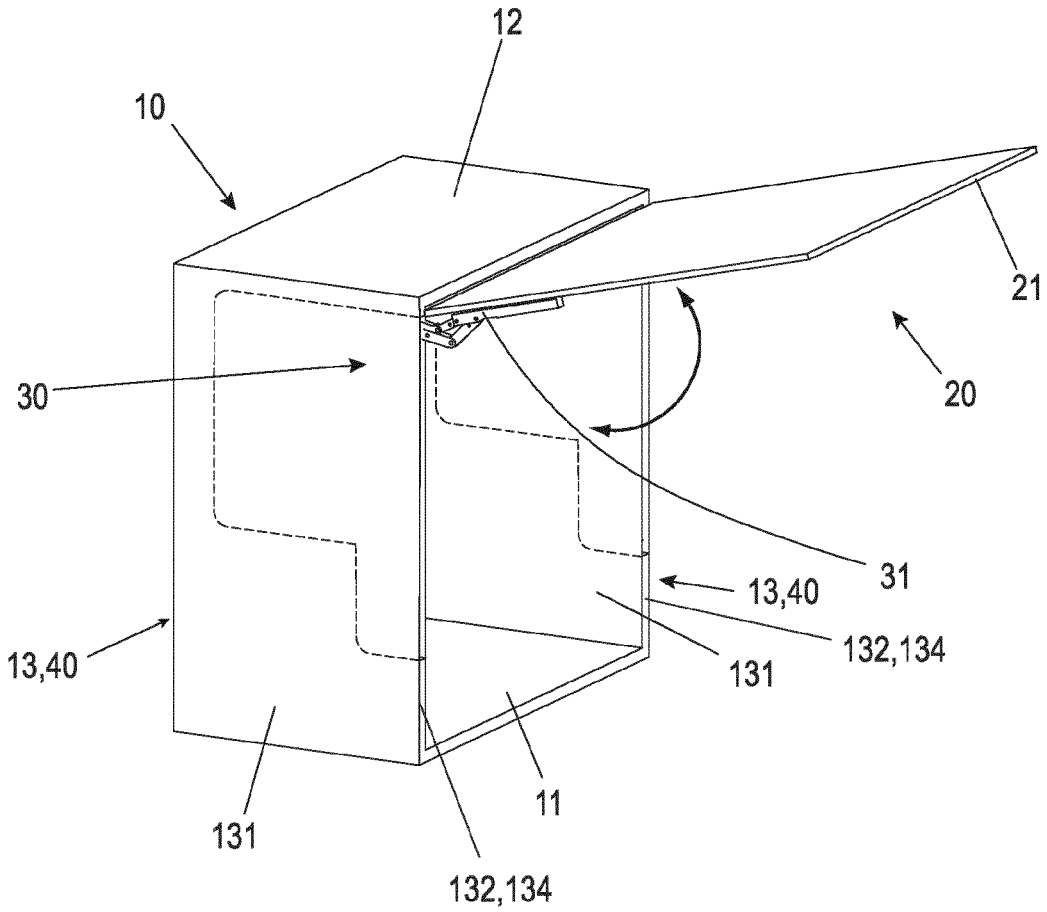

FIG. 1 shows an isometric illustration of a top cabinet, for example, of a kitchen, as a first exemplary embodiment of an item of furniture having furniture walls, which are manufactured from a construction panel according to the application.

The top cabinet comprises a furniture body 10 having a bottom panel 11 and a top panel 12 and also two side walls 13. A rear wall is preferably provided for stability reasons, inter alia, but is not shown in this exemplary embodiment.

The furniture body 10 is open to the front to obtain access to the interior of the cabinet. A flap arrangement 20 having a one-piece flap 21 is provided to be able to close the opening of the furniture body 10. The one-piece flap 21 is pivotably mounted along its top horizontal lateral edge. For this purpose, fittings 30 are provided, which are connected to the one-piece flap 21 using a lever mechanism 31 in the upper region of the flap.

The fittings 30 are arranged inside the respective side wall 13 (except for the lever mechanism 31, which is extended in the open position shown). In the closed state of the flap 21, the lever mechanism 31 is completely retracted into the side wall 13, possibly except for installation elements for the connection to the flap 21. The region inside the side wall 13, in which the fitting 30 is located, is indicated in FIG. 1 by a dashed line.

The side wall 13 is distinguished by lateral faces 131, which are ideally in one piece and can have a continuously identical surface quality over the entire area. The surface of the one-piece lateral faces 131 can create design effects by way of various patterns, surface qualities, or various colors. This preferably applies both to an outer of the lateral faces 131 and also to an inner of the lateral faces 131 facing toward the interior of the furniture body 10. The side walls 13 moreover have an end face 132 comprising an opening 133 in the region of the fitting 30, into which the lever mechanism 31 of the fitting 30 plunges or out of which the lever mechanism 31 extends. In the closed state of the flap arrangement 20, the lever mechanism 31 is completely plunged into the opening 133 except for possible fastening means, using which it is connected to the one-piece flap 21 here. The end face 132 is provided with a narrow side coating 134, which can be formed as an edge band 134.

According to the application, the side walls 13 are manufactured from construction panels 40, which will be explained in greater detail in conjunction with FIG. 5 et seq.

Figure 2A:
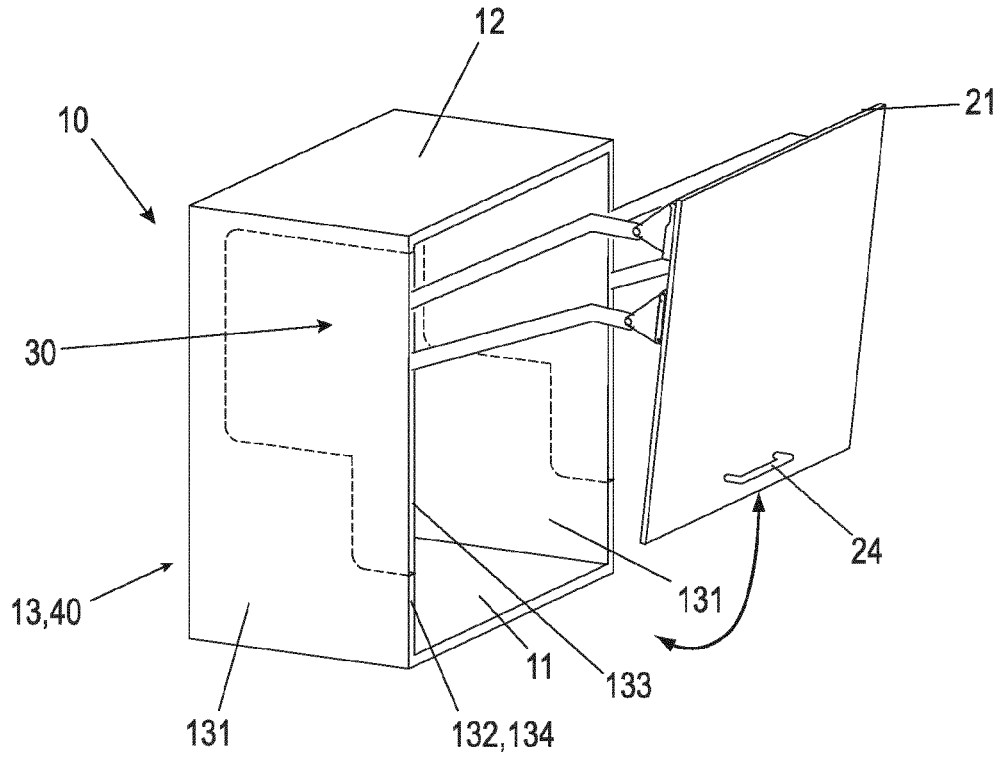
Figure 2B:
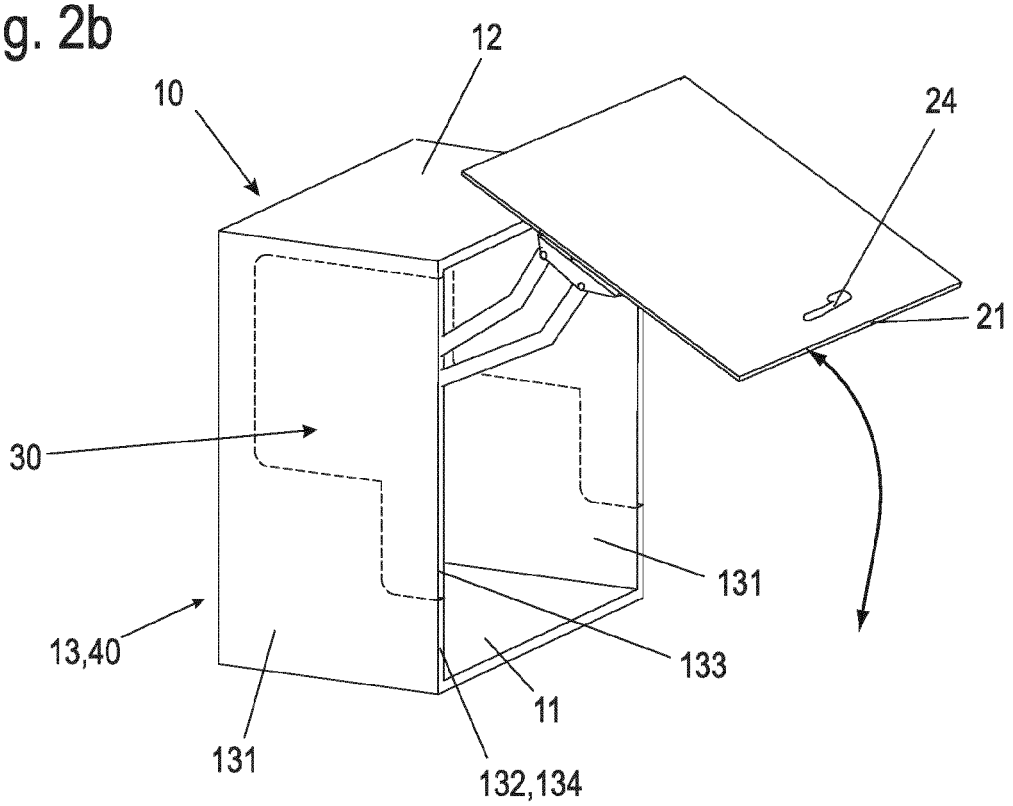

A further top cabinet is shown in each of FIGS. 2*a* and 2*b* as an example of an item of furniture having a side wall according to the application in an isometric view.

As in the example of FIG. 1, a one-piece flap 21 is provided as a flap arrangement 20 to close a furniture body 10 to the front. The two FIGS. 2*a* and 2*b* differ in the open state of the flap arrangement 20. FIG. 2*a* shows a partially open state of the flap arrangement 20, while FIG. 2*b* shows the maximally open state of the flap arrangement 20. In contrast to the exemplary embodiment of FIG. 1, in the present case a lift and pivot fitting is provided, which enables a combined pivot and displacement movement of the one-piece flap 21. In the completely open position shown in FIG. 2*b*, at least a part of the flap 21 is positioned above the top panel 12 of the furniture body 10. In this manner, a good access to the interior of the furniture body 10 is achieved without the bottom edge of the flap 21, in the region of which a handle 24 is installed, pivoting up to the height of the top panel 12. In this manner, even in the case of a top cabinet installed high up in the room, the flap 21 is well reachable in the open position to be able to close it again.

As in the exemplary embodiment of FIG. 1, the side walls 13 are also manufactured here from construction panels 40, in which the fitting 30 is already accommodated.

Figure 3A:
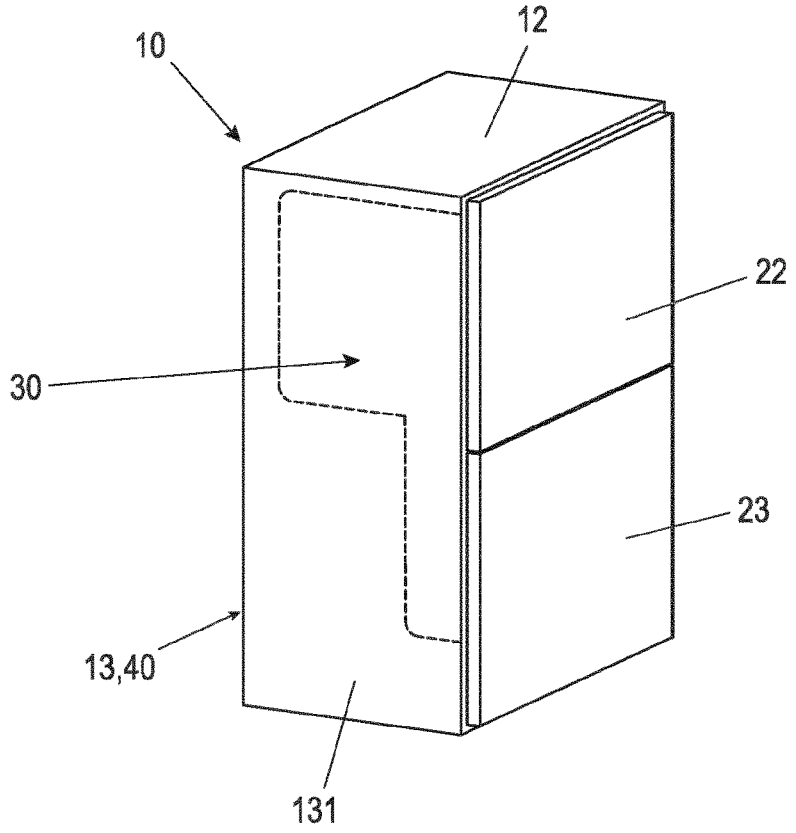
Figure 3B:
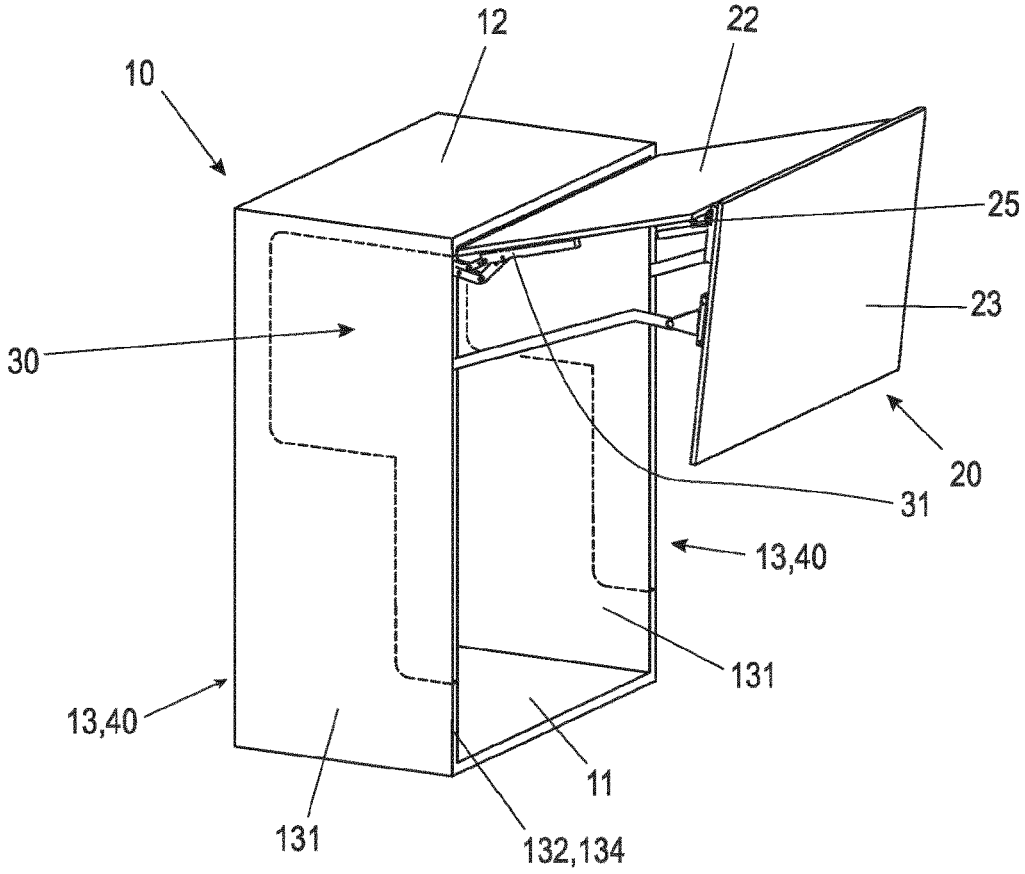

A further exemplary embodiment of a top cabinet having furniture body 10 and flap arrangement 20 is shown in FIGS. 3*a* and 3*b*. FIG. 3*a* shows the flap arrangement 20 in a closed position and FIG. 3*b* shows it in an open position.

In this item of furniture, a two-part flap arrangement 20 is provided, which comprises a top flap part 22 and a bottom flap part 23. The side walls 13 are again manufactured from construction panels 40, which accommodate a fitting 30. It is coupled using lever mechanisms 31 to both the top flap part 22 and also the bottom flap part 23. Moreover, additional hinges 25 are provided, which couple the top and the bottom flap parts 22, 23 to one another in a pivotable manner along their connecting line. Depending on the embodiment of the flap fitting, the hinges can also be omitted.

As in the exemplary embodiment of FIGS. 2*a*, 2*b*, a good access to the interior of the furniture body 10 is also achieved here, without the flap arrangement 20 pivoting excessively far upwards so it is difficult to reach for the user in the open state.

Figure 4:
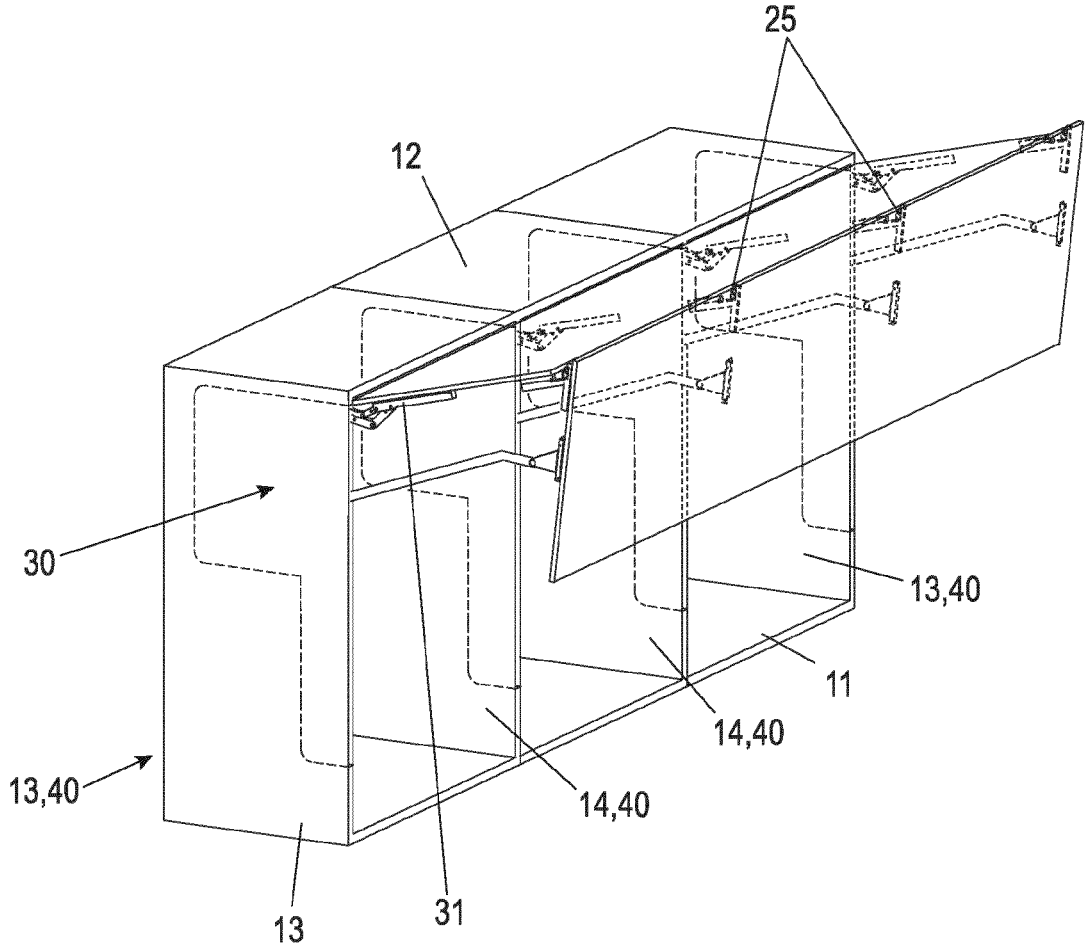

FIG. 4 shows a further top cabinet having furniture body 10 and flap arrangement 20, in which fittings 30 for guiding the flap arrangement 20 are arranged in a construction panel 40 according to the application. In the illustrated example, the furniture body 10 comprises an interior divided by vertical intermediate walls 14. In the present case, two intermediate walls 14 are provided, which divide the interior into three portions. In this embodiment, each intermediate wall 14 is manufactured from one construction panel 40. The illustrated arrangement can also be implemented having only one intermediate wall or more than the two intermediate walls 14 shown, however.

The flap arrangement 20 is in two parts compared to the exemplary embodiment of FIGS. 3*a* and 3*b* having a top flap part 22 and a bottom flap part 23. In its width, the flap arrangement 20 and also the top and the bottom flap parts 22, 23 extend over the entire furniture body 10. To be able to guide the flap arrangement 20 cleanly, in the present case fittings 30 are also arranged in the intermediate walls 14. Both the side walls 13 and also the intermediate walls 14 are produced from construction panels 40 according to the application.

In all illustrated exemplary embodiments, the construction panels 40 are distinguished by continuous lateral faces having uniform surface appearance and haptics over the entire area. In particular, no transition in the region of the edge of the fitting 30 is recognizable in the surface.

Figure 5A:
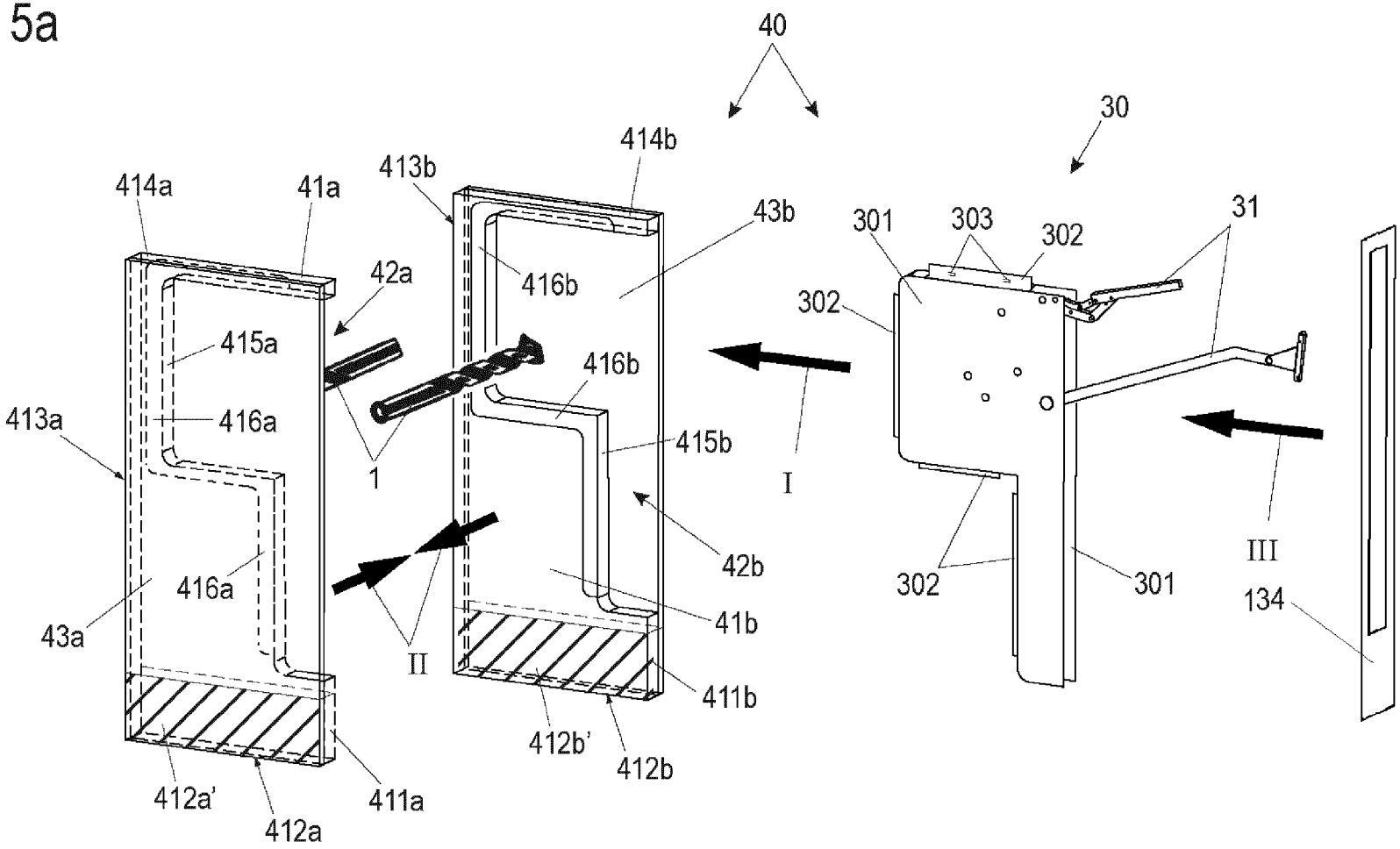

A first exemplary embodiment of a construction panel 40, using which this is achieved, is shown in FIG. 5*a* in an isometric exploded view. The construction panel 40 shown can be used, for example, as a side wall 13 in the exemplary embodiments of FIGS. 1-4 and also as an intermediate wall 14 in the exemplary embodiment of FIG. 4.

The construction panel 40 comprises two main elements constructed in a mirror image here, which each comprise one plate-shaped core half 41*a*, 41*b*, which are both provided with a recess 42*a* or 42*b*, respectively. After a later assembly, the two core halves 41*a*, 41*b* jointly form a core 41 of the construction panel 40. The recesses 42*a* or 42*b*, respectively, can also be formed differently. The shape of the recesses 42*a* and 42*b*, respectively, is dependent on the fitting to be used and its external geometry.

The core halves 41*a*, 41*b* are manufactured, for example, from a chipboard panel or a medium-density fiberboard (MDF) or high-density fiberboard (HDF). The core halves 41*a*, 41*b* each have a rectangular dimension of the size which the side wall or intermediate wall has later in the furniture body to be manufactured (cf., for example, side wall 13 of the furniture body 10 according to the exemplary embodiments of FIGS. 1-4).

A planar large recess 42*a*, 42*b*, which is open toward a first end face 411*a*, 411*b*, is introduced into each of the core halves 41*a*, 41*b*. A narrow section of the end face 411*a*, 411*b* only remains in the top and/or bottom region of the core halves 41*a*, 41*b*. The recesses 42*a*, 42*b* can be embodied in mirror symmetry. In the region located in between, the edge of the recess 42*a*, 42*b* now forms an end face 415*a*, 415*b*, which follows the contour of the recess 42*a*, 42*b* and is offset inward. The first end face 411*a* or 411*b*, respectively, is also referred to hereafter as the front end face 411*a*, 411*b*.

The three further end faces of each core half 41*a*, 41*b*, a respective bottom left end face 412*a*, 412*b*, a rear end face 413*a*, 413*b*, and a top end face 414*a*, 414*b* in FIG. 5*a* extend linearly in accordance with the rectangular dimensions.

Although the core halves 41*a*, 41*b* are of equal thickness in the illustrated example, the term "core halves" is also to be understood as core halves 41*a*, 41*b* of different thicknesses in the scope of the application.

The recesses 42*a*, 42*b* correspond in their contour to the external contour of a fitting 30 to be inserted, an approximately L-shaped contour here. The recesses 42*a*, 42*b* can each be introduced, for example, by milling using the symbolically shown milling tools 1 in the core halves 41*a*, 41*b*. Other machining technologies such as drilling in conjunction with (plunging) saw cuts can also be used to create the recesses 42*a*, 42*b*. As an alternative to cutting or removing methods for producing the recess 42*a*, 42*b*, a forming method (for example, according to the norm DIN 8580) can also be used to produce the core halves 41*a*, 41*b*, by means of which the respective core half 41*a*, 41*b* at least partially already obtains its finished form including the recess 42*a*, 42*b*.

Using a corresponding forming tool, the recess can also be pressed during the production of the panel. The milling can take place through the entire thickness of the respective core half 41*a*, 41*b*. Depending on the thickness of the fitting 30 to be inserted, it can also be provided that a thin wall of the material of the core halves 41*a* or 41*b* is left standing in the region of the recess 42*a* or 42*b*, respectively.

It is to be noted that processing can take place from one of the lateral faces of the respective core half 41*a*, 41*b*. Processing only from the first end face 411*a* or 411*b*, respectively, is not required in the core halves 41*a*, 41*b*. The recess can thus assume any arbitrary depth without problems (viewed from the original end faces 411*a*, 411*b*) and is also capable of accommodating fittings 30 having a large installation depth. Moreover, shapes such as, for example, undercuts can be produced, which are not possible in the case of processing from the end face of a panel. When assembled, the core halves 41*a*, 41*b* form a core 41, in which the recesses 42*a*, 42*b* supplement one another to form a recess 42, which accommodates the fitting 30.

A cover layer 43*a* or 43*b*, respectively, is applied in a mirror image to each of the core halves 41*a*, 41*b*, for example, the cover layers are laminated on. This can take place either before or after the preparation of the recesses 42*a*, 42*b*. These cover layers 43*a*, 43*b* are preferably already provided with a decorative surface. Their thickness is in a range from several tenths of millimeters (millimeters) up to approximately 2 or 3 mm. Typical coating materials based on plastic, painted paper layers, veneers, or cork can be used as cover layers 43*a*, 43*b*. Leather or fabrics can also be used. With corresponding material selection of the core 41 (for example, solid wood or metal), the cover layers 43*a*, 43*b* can also be omitted.

The core halves 41*a*, 41*b* can, in a simple manner, be complete 8 mm panels, possibly already provided on both sides with the cover layers 43*a*, 43*b*, for example, to produce a standard furniture wall having a thickness of 16 mm, wherein the recesses 42*a*, 42*b* are introduced into the core halves from one side. In addition to the cover layers 43*a*, 43*b*, the two panels can also already be provided on the end faces with a narrow side coating, for example, an edge veneer. The recesses 42*a*, 42*b* ideally have a base made of the material of the core halves 41*a*, 41*b*, so that the adjoining cover layers 43*a*, 43*b* are not damaged. The edge band on the front end face 411*a*, 411*b* can be milled on the rear. After the insertion of the fitting 30 into a recess, the core halves 41*a*, 41*b* can be adhesively bonded, wherein the core halves 41*a*, 41*b* can also comprise a cover layer in the joint in this embodiment, if the starting material of the core halves 41*a*, 41*b* is already coated on both sides. The fitting 30 can also be adhesively bonded on the edge band milled at the rear in this case. The edge band can also be applied later, if the fitting 30 is already inserted into the recess 42. The narrow side coating or the edge band covers the end-face housing wall of the fitting in this case, so that it is concealed.

For the installation, the fitting 30 can be guided, for example, in a first installation step I between the two core halves 41*a*, 41*b* and both core halves 41*a*, 41*b* can be closed like a mussel around the fitting 30 and connected to one another in a second installation step II. In a third installation step III, the narrow side coating or the edge band 134 is applied to the end face 411*a*, 411*b*.

Alternatively, the fitting 30 can first be inserted into one of the recesses, for example, the recess 42*b* of the core half 41*b*. The second main element, i.e., the core half 41*a* having the cover layer 43*a* and the recess 42*a*, can then be slipped over the fitting 30 and the two core halves 41*a*, 41*b* are assembled and connected to one another.

One possible type of connection of the fitting 30 to the core halves 41*a*, 41*b* and/or the cover layers 43*a*, 43*b* will be described in greater detail in conjunction with FIG. 5*b*.

In the exemplary embodiment shown in FIG. 5*a*, the respective core half 41*a*, 41*b* is milled adjoining the end face 415*a* or 415*b*, respectively, on the side facing away from the cover layer 43*a*, 43*b* in the region of the respective end face 414*a*, 414*b* of the core halves 41*a*, 41*b* at the edge of the recesses 42*a*, 42*b* in portions in such a way that shoulder surfaces 416*a* or 416*b*, respectively, are formed, which form a shoulder in relation to the remaining lateral faces of the core halves 41*a*, 41*b*.

The fitting 30 comprises two side plates 301 spaced apart from one another, which laterally delimit the fitting 30 and provide the pivot points for the lever mechanism 31. Spacer sleeves and/or bolts, which connect the side plates 301 to one another and fix them parallel to one another at a fixed spacing, can be provided between the side plates 301. In alternative embodiments of the fitting 30, screw elements can also be used as spacers, which offer the option of at least slightly varying the spacing of the side plates 301 and thus adapting it to the thickness of the core 41.

Tabs 302 protrude outward beyond the side plates 301 on various sides on the fitting 30. The tabs 302 can be formed, for example, as bent-over side plates 301 corresponding to a fold.

The tabs 302 are arranged in a plane in the middle in relation to the side plates 301. Protruding staples 303, for example, formed from upright material of the tabs 302, are arranged transversely in relation to the tabs 302 in the area of the tabs 302.

Figure 5B:
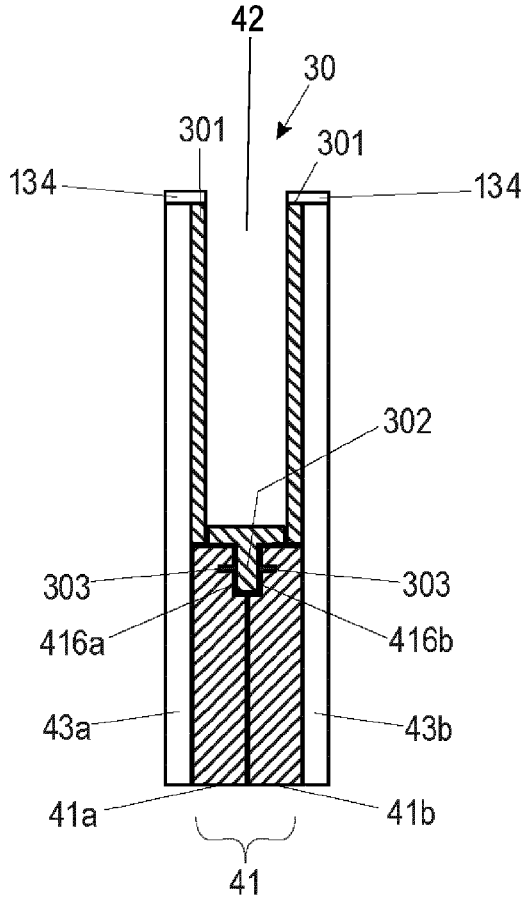

FIG. 5*b* shows a detail of the construction panel 40 of FIG. 5*a* in an assembled state in a schematic section in the region of the edge of the inserted fitting 30. It can be seen that the tabs 302 are fixed in the region of the shoulder areas 416*a* and 416*b*, respectively, between the core halves 41*a*, 41*b*, which are connected to one another. The staples 303 are pressed here on both sides into the material of the core halves 41*a*, 41*b* by the joining together of the core halves 41*a*, 41*b* and thus fasten the fitting 30 in the construction panel 40 on the core halves 41*a*, 41*b*. Moreover, in this manner the core halves 41*a*, 41*b* are also connected to one another via the staples 303 and the tabs 302.

If one recess 42*a*, 42*b* does not correspond to the thickness of the corresponding core half 41*a*, 41*b*, the side plate 301 of the fitting 30 can additionally be adhesively bonded in a planar manner to the base of the recess 42*a*, 42*b* of the core half 41*a*, 41*b*.

The fitting 30 and the core 41 formed from the two core halves 41*a* and 41*b* preferably have equal thickness. The equal thickness is preferably in a range of 6 mm to approximately 10 mm. The core 41 and the fitting 30 thus form a unit, in which the fitting 30 is surface-flush with the surface of the core 41 on both sides. Furthermore, the front edges of the fitting 30 also extend flush with the two remaining portions of the actual first end faces 411*a*, 411*b* of the core 41.

A narrow side coating 134, which can be formed as an edge band 134, is applied to the end faces 411*a*, 411*b* and the front edges of the fitting 30. The end face of the construction panel 40 is homogeneously concealed by the edge veneer, so that the side plates 301 and/or the housing outer wall of the fitting 30 are concealed.

Figure 5C:
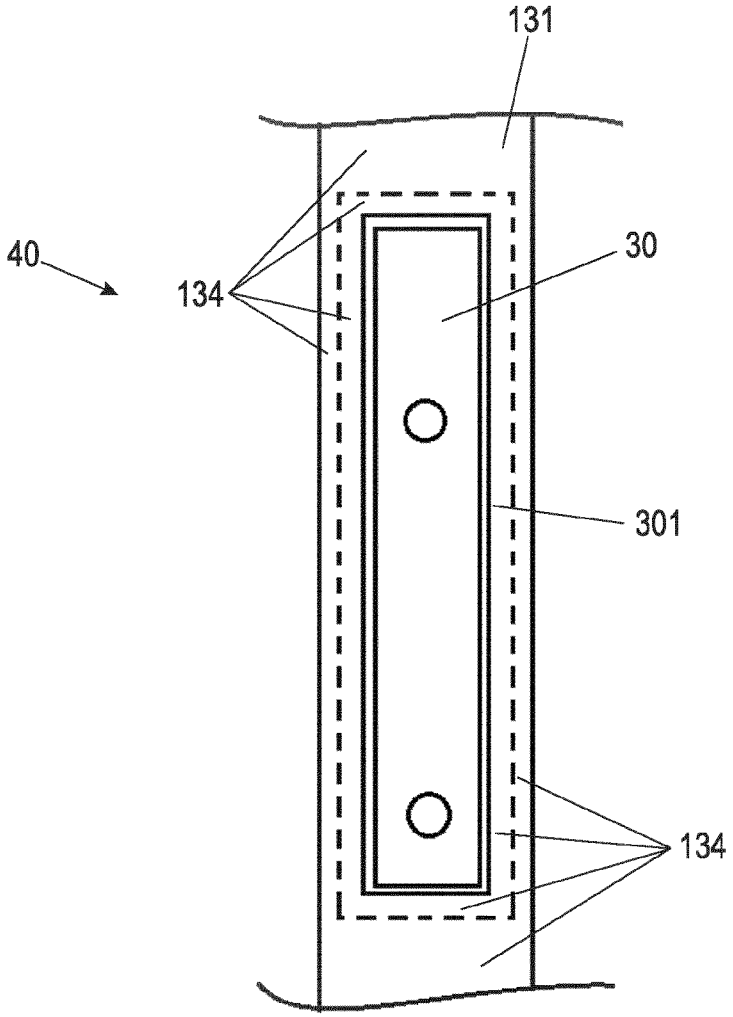

FIG. 5*c* shows a detail of a frontal view of an end face 132 of the construction panel 40 of FIG. 5*a* having inserted fitting. An edge band 134 is applied to the end face 132, which both covers the end face 411 of the core, and also covers the side plates 301 and/or the housing outer wall of the fitting 30. The housing wall located concealed behind the edge band is shown by dashed lines here. The lever mechanism 31 of the fitting can move freely through an opening of the edge band 133. In this exemplary embodiment, the narrow side coating or the edge band 134 is applied after the installation of the fitting into the recesses 42. The edge band 134 can also already have been applied beforehand to the end face 411*a*, 411*b* of the core halves 41*a*, 41*b*. In this case, milling is performed behind the edge band 134 and it is adhesively bonded to the end-face housing outer wall during the insertion of the fitting 30.

In the described manner, the construction element 40 results, from which a side wall or an intermediate wall, for example, which already contains the fitting 30, can be manufactured in a simple manner during the production of a furniture body.

To be universally usable, it is provided according to the application that on at least one of the further end faces 412*a, b*, 413*a, b*, and/or 414*a, b* of the core halves 41*a*, 41*b*, the construction panel 40 comprises a machinable portion, within which the construction panel 40 can be shortened in the production process of the furniture body, for example, can be sawn off, or into which profiles can be milled or installation elements can be attached.

In the example shown in FIG. 5*a*—by way of example only on the bottom end face 412*a, b*—a machinable portion 412*a*' or 412*b*', respectively, is provided, within which the construction panel can be processed, without the fitting 30 being damaged and without the construction panel 40 and in particular the fastening of the fitting 30 losing stability. The protruding machinable portion 412*a', b'*, which is indicated by a shading in the figure, can also accommodate the installation of fastening elements, for example, for elements for the internal organization of the item of furniture, or further fittings can be fastened if needed.

Figure 6:
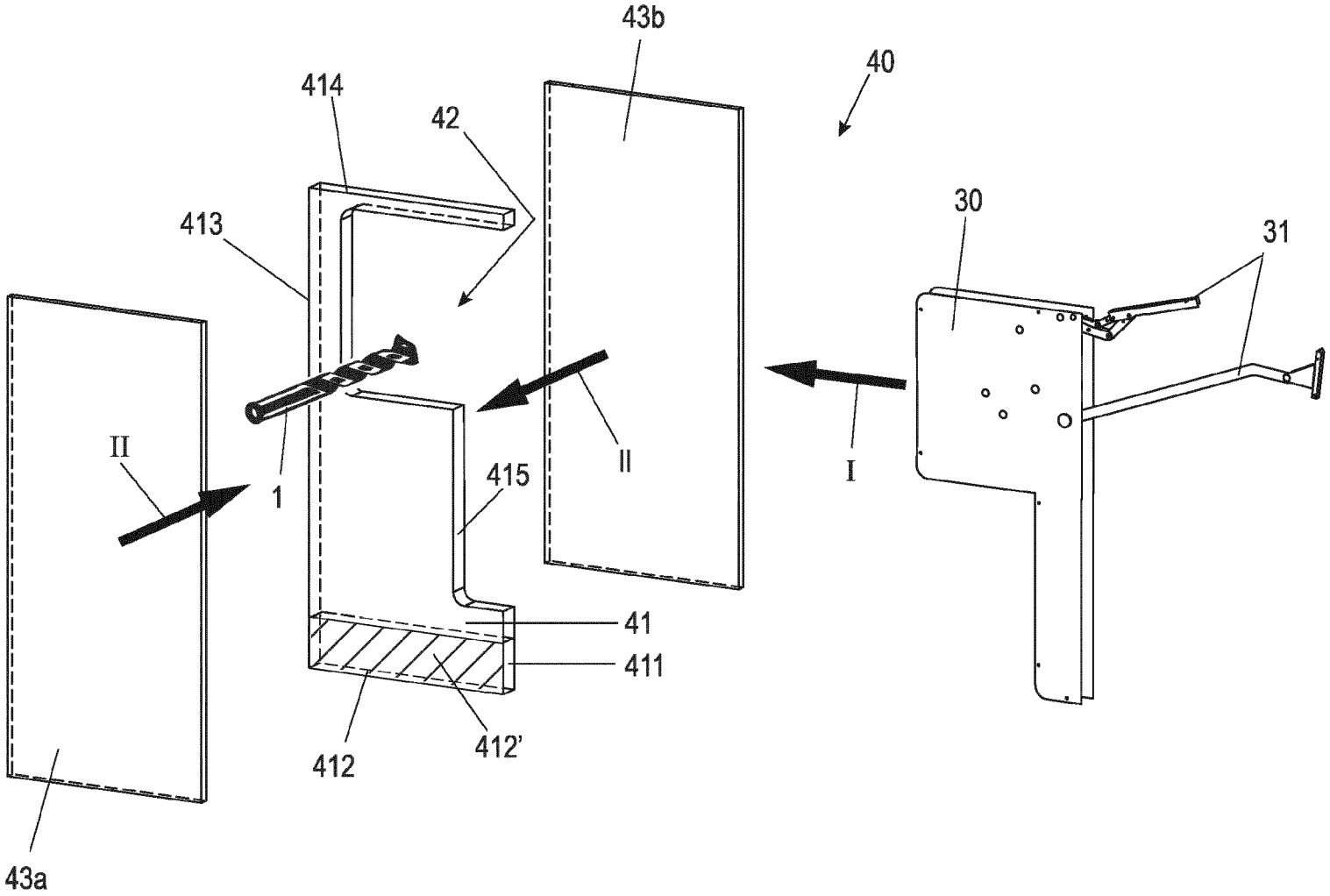
FIG. 6 shows a second exemplary embodiment of a construction panel for a furniture wall in a schematic exploded view.

FIG. 6 shows an isometric exploded view of an alternative structure of a construction panel 40 and illustrates its production.

The construction panel 40 comprises a core 41, again manufactured, for example, from a chipboard panel or MDF or HDF panel. A recess 42 for the fitting 30 is introduced into the core 41, for example, milled in from one of the lateral faces. The recess 42 is open toward a first end face 411 of the core 41, so that the lever mechanism 31 of the fitting can plunge into the construction panel 40. In the illustrated example, the core 41 is in one piece and only abuts below the fitting 30. It can alternatively be provided that a further core element is also arranged on other sides of the fitting 30, in particular on its top side.

The core 41 and the fitting 30 can be connected to one another via connecting elements (not shown here), for example, screws, clamps, pins, staples, or the like. An adhesive bond can also be provided in addition to the mentioned connecting elements or as the only connection.

Cover layers 43*a*, 43*b* are applied, in particular adhesively bonded or laminated onto the arrangement made of the core 41 and the fitting 30 possibly connected thereto from each side. The fitting 30 is selected in this case with respect to its material and the material thickness, for example, of the side plates of the fitting 30 so that it is also not compressed during a lamination process, which could result in an irregularity of the surface of the cover layers 43*a*, 43*b*. Smaller irregularities in the side plates of the fitting 30 are equalized by the cover layers 43*a*, 43*b* and/or by the adhesive layer located between cover layer 43*a*, 43*b* and fitting 30. Such smaller irregularities can originate, for example, due to the bearing points of bolts, which are used for the pivotable mounting of the lever mechanism 31 in the fitting 30.

The production method of the construction panel 40 symbolized in FIG. 6, in which the core 41 and the fitting 30 are first aligned matching with one another and possibly connected to one another and then brought together with the cover layers 43*a, b* to form the construction panel 40, also enables the use of a fitting 30 which, as shown, extends over the entire width of the construction panel 40, for example. In this manner, larger and more complex fittings 30 can also be used in the construction panel 40 than would be possible in a pocket milled out on an end face of a side wall.

A machinable portion 412' is again provided as a protrusion by way of example on the lower end face 412, within which the construction panel 40 can be processed or within which further elements can be installed.

The narrow side coating, for example, an edge veneer, provided for the end face 411 is not shown in FIG. 6. The edge band covers the end face of the core 41 and the end face of the outer wall of the fitting 30.

Figure 7:
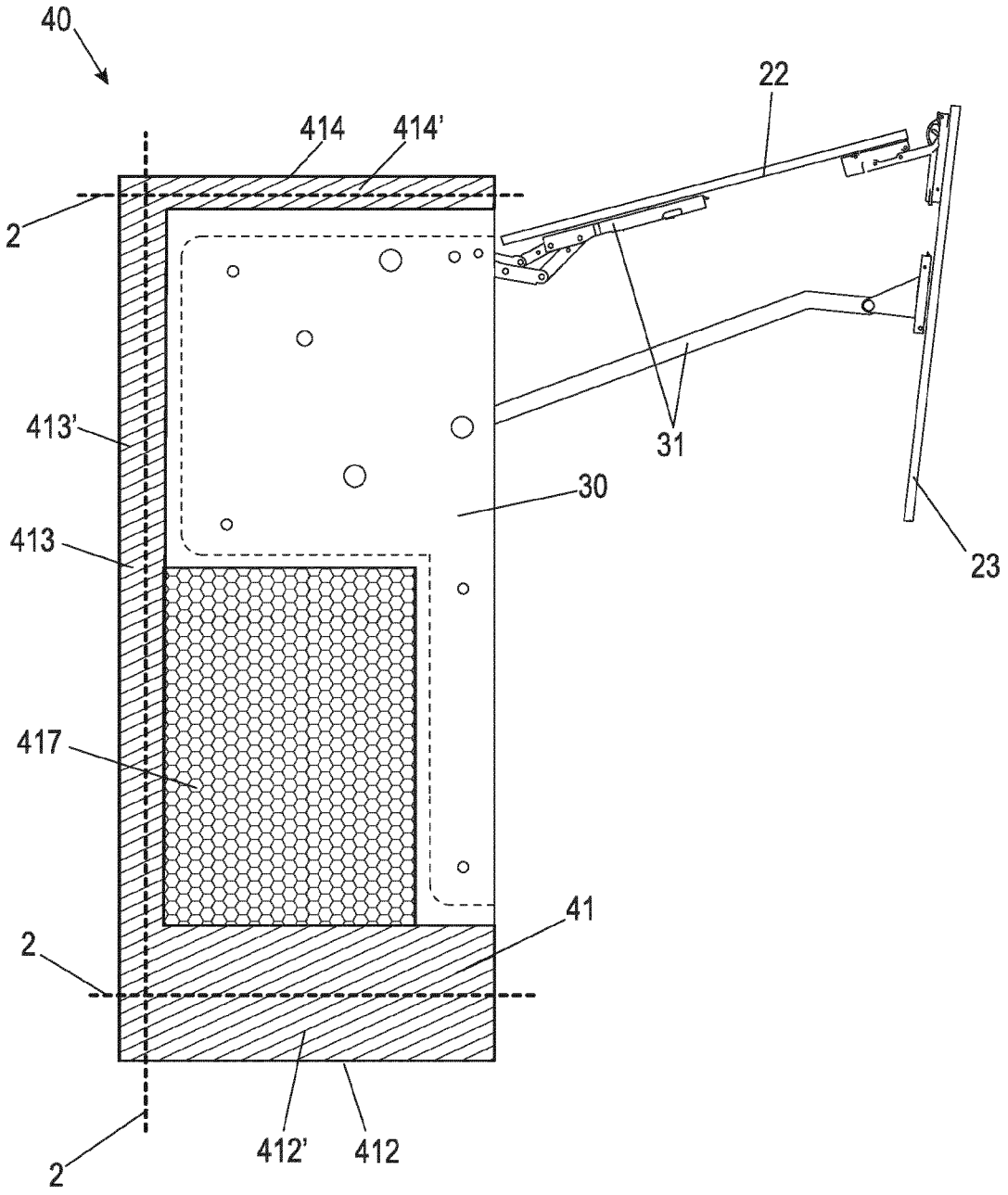
FIG. 7 shows a third exemplary embodiment of a construction panel for a furniture wall in a schematic view.

FIG. 7 shows a further exemplary embodiment of a construction panel 40 having a core 41 and an integrated fitting 30. For illustration, a two-part flap having portions 22, 23 is installed on the fitting 30. Moreover, an outer cover layer is illustrated transparent to show the internal structure of the construction panel 40.

The core 41 of the construction panel 40 does not homogeneously consist of one material in this example, but rather is formed as a composite material. In edge regions, this core 41 is again manufactured from a compacted material, for example, a chipboard panel, an HDF panel, or an MDF panel. In an inner region, in particular in the lower part of the core 41, in which the fitting 30 is formed narrower, a light honeycomb structure material 417 is provided, for example, a cardboard material. By using the honeycomb structure material 417, the weight of the construction panel 40 and also the material costs can be reduced. Nonetheless, a sufficient stability of the construction panel 40 is achieved in particular in conjunction with the applied and preferably glued-on cover layers 43*a*, 43*b*.

The construction panel 40 shown in FIG. 7 again comprises protruding machinable portions 412', 413', and 414' as processing zones, in this example on three end faces 412, 413, and 414, i.e., on all end faces except for the first end face 411, into which the fitting 30 is inserted. The processing zones are spaced apart sufficiently from the fitting 30 so that the stability of the construction panel 40 is not impaired. In addition to a processing zone, an installation zone extending somewhat farther toward the fitting 30 can be marked, within which installation elements, for example, connecting elements to further walls of the furniture body, can be attached on the construction panel 40.

In the region of the protruding machinable portions 412', 413', and 414', dashed cutting lines 2 are indicated by way of example, along which the construction panel 40 can be cut to length during the manufacturing of a furniture body. The prefinished construction panel 40 having already integrated fitting 30 can thus be used to produce an item of furniture having wall-integrated fitting with low expenditure.

Further fittings, for example, wall hangers or connecting elements for, for example, internal organizers or connection interfaces for the furniture body, can be integrated into the construction panel 40.

Furthermore, electrical lines and also further electrical components can be integrated into the construction panel 40 for electrification of the item of furniture. The integration of lighting units, for example, LED lights, is also possible.

The size of the protruding machinable portions 412', 413', and 414' and/or their edges can preferably be indicated on the construction panel 40 to prevent processing in a region in which the processing could result in damage to the fitting 30 or influences the integrity and/or stability of the construction panel 40. One advantageous way of indicating the edges of the protruding machinable portions 412', 413', and 414' is an imprint of the edges on a removable protective film, using which the cover layers 43*a, b* are moreover protected during the further processing. The location and dimensions of an integrated fitting 30 can also thus be indicated. Processing regions for fastening means for internal organizers and/or furniture connecting regions can also be shown on the protective film. These regions can also be located in a surface region that cannot be sawn off.

Alternatively, or additionally, items of information about the construction panel 40 and/or its processing capability can be integrated into the construction panel 40 in the form of a readable data carrier. For example, an RFID (radiofrequency identification) transponder can be inserted into the construction panel 40, preferably below one of the cover layers 43*a, b*. The position of the RFID transponder can optionally be externally indicated on the construction panel 40, for example, again on the mentioned protective film.

The RFID transponder can contain, for example, an article number, the construction year, a batch, items of color information, dimensions and position of the fitting, type and carrying capacity of the fitting, etc. as data, which can be read out wirelessly via a reading device. At the furniture producer, it can thus be ensured by a readout, for example, directly at a machine tool, that the correct type of construction panel is supplied for an item of furniture to be produced.

In a further embodiment, a wall hanger is provided, preferably on the rear end face 413 of the construction panel 40, using which the item of furniture can be hung on a building wall.

Figure 8:
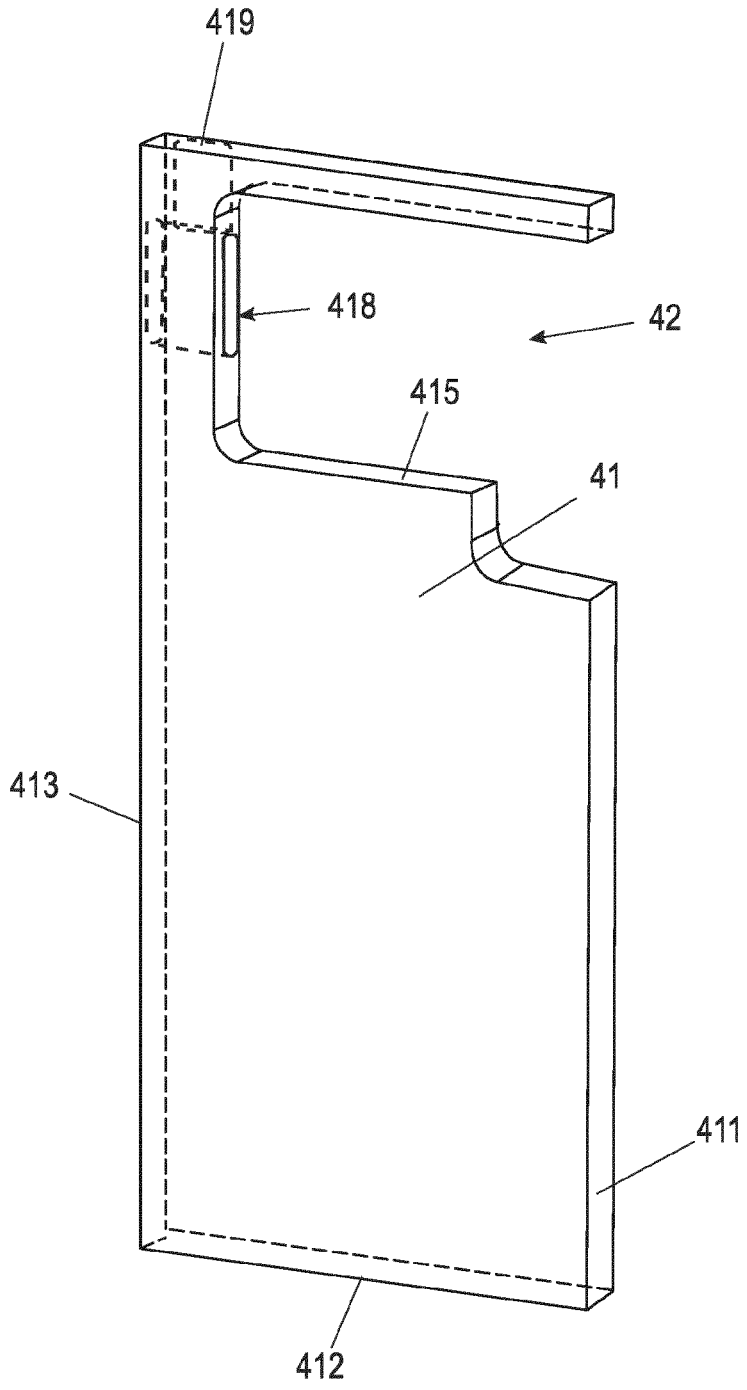
FIG. 8 shows an exemplary embodiment of a core of a construction panel for a furniture wall in a schematic view.

FIG. 8 shows a core 41 for a construction panel 40, which is produced to accommodate a wall hanger. The core 41 has a receptacle channel 418 facing from the recess 42 toward the rear end face 413 for this purpose, in which the wall hanger can be inserted. A further channel 419 is introduced into the core 41 from above, i.e., from the top end face 414, which extends up into the receptacle channel 418. Adjusters of an inserted wall hanger can be reached through the further channel 419, for example, for the height and/or inclination adjustment with the aid of a tool, to be able to adjust an item of furniture hung on a building wall.

The receptacle channel 418 can extend up into the end face 415 of the recess 42. In this manner, the wall hanger can be connected directly to the fitting 30.

Figure 9A:
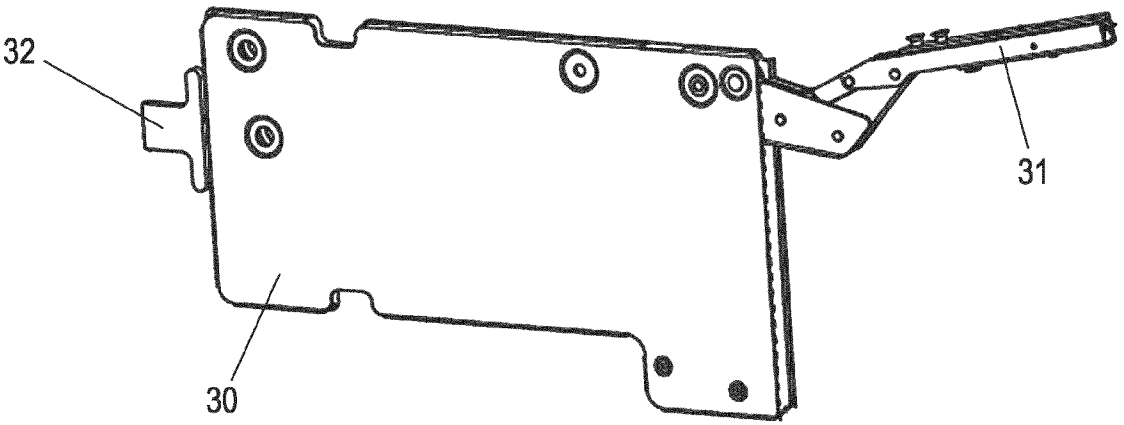
FIGS. 9*a, b* show a fitting having a wall mount for use in a construction panel in various illustrations.

A fitting 30 insertable into the core 41 of FIG. 8 is shown in an isometric view in FIG. 9*a*. A wall hanger 32, which protrudes into the receptacle channel 418 upon insertion of the fitting 30 into the core 41 according to FIG. 8, is installed on its side opposite to the lever mechanism 31. It can be provided that the wall hanger 32 is placed on a screw head or hook of a screw screwed into the building wall.

Figure 9B:
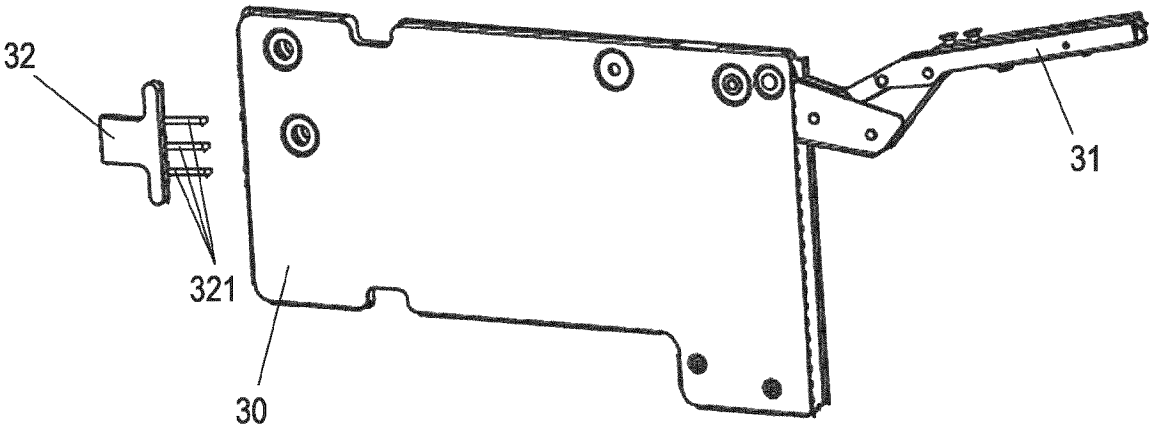

FIG. 9*b* shows the wall hanger 32 before its installation on the fitting 30. The wall hanger 32 comprises connecting means, using which it can be installed as much as possible without tools on the fitting 30. In the present case, connecting pins 321 are provided as connecting means, which lock in corresponding receptacles of the fitting 30 when the wall hanger 32 is inserted into the fitting 30. In this embodiment, the wall hanger 32 can be inserted if needed from the outside in the fitting 30 into the receptacle channel 418 of a construction panel 40.

In principle, a wall hanger of the construction panel 40 could also be fastened on the core 41. During the installation of the illustrated wall hanger 32 on the fitting 30, a large-area force distribution from the wall hanger 32 to the core 41 is advantageously achieved and forces acting locally on the material of the core 41 are prevented from exceeding the tear resistance of the (wood) material of the core 41. Moreover, forces which act on the fitting 30, for example, the weight and/or lever forces of a door or flap guided by the fitting 30, are dissipated effectively directly via the wall hanger 32 onto the building wall.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 milling tool
2 cutting line
10 furniture body
11 bottom panel
12 top panel
13 side wall
131 lateral face
132 end face
133 opening in end face
134 narrow side coating/edge veneer
14 intermediate wall
20 flap arrangement
21 one-piece flap
22 top flap part
23 bottom flap part
24 handle
25 hinge
30 fitting
301 side plate
302 tab
303 staple
31 lever mechanism
321 wall hanger
321 connecting pin
40 construction panel
41 core
41*a, b* core half
411, 411*a*, 412*b* first (front) end face
412, 412*a*, 412*b* further (bottom) end face
412', 412*a*', 412*b*' machinable portion
413, 413*a*, 413*b* further (rear) end face
413' machinable portion
414, 414*a*, 414*b* further (top) end face
414' machinable portion
415, 415*a*, 415*b* end face of the recess
416*a, b* shoulder surface
417 honeycomb structure material
418 receptacle channel
419 further channel
42, 42*a*, 42*b* recess
43*a, b* cover layer
I, II installation step

The invention claimed is:

1. A construction panel for a furniture wall of a furniture body, the construction panel comprising:

a plate-shaped core, which comprises a first end face and further end faces, wherein a recess arranged in the plate-shaped core extends at least along a portion of the first end face of the construction panel and is configured to accommodate a fitting in the recess, wherein the fitting is configured to guide a movable furniture part and the fitting comprises a housing outer wall, wherein the plate-shaped core comprises chipboard, medium-density fiberboard, or high-density fiberboard; and at least one machinable portion, which is located outside the recess, in a region of at least one of the further end faces, wherein the fitting is a flap fitting comprising a lever mechanism configured to guide the movable furniture part and the fitting is located in a region of the recess in a closed state of the movable furniture part, and wherein the lever mechanism plunges into the portion of the first end face over which the recess extends, and wherein the construction panel is a side wall or intermediate wall of the furniture body.

2. The construction panel of claim 1, wherein the core is arranged between two laterally applied cover layers.

3. The construction panel of claim 2, wherein the fitting is connected to the plate-shaped core and/or at least one of the two laterally applied cover layers.

4. The construction panel of claim 3, wherein the fitting is adhesively bonded to the plate-shaped core and/or at least one of the two laterally applied cover layers.

5. The construction panel of claim 1, wherein in which the plate-shaped core comprises two core halves, which abut one another in a plane parallel to lateral faces of the construction panel.

6. The construction panel of claim 5, wherein the two core halves have a respective recess and at least one of the core halves has a reduced thickness along an edge of the respective recess in such a manner that a shoulder surface is formed toward the recess, on which at least one tab protruding beyond its edge of the fitting rests.

7. The construction panel of claim 6, wherein at least one staple is extended from the at least one tab, the at least one staple is pressed into the material of at least one of the two core halves in a region of the shoulder surface.

8. The construction panel of claim 1, wherein the fitting comprises a housing outer wall having maximum spacing that is less than a thickness of the plate-shaped core.

9. The construction panel of claim 1, wherein a thickness of the construction panel is between 15 mm and 20 mm.

10. The construction panel of claim 1, further comprising:

an integrated data carrier, in which items of information on the construction panel and/or the fitting are stored.

11. The construction panel of claim 10, further comprising:

an integrated transponder comprising the data carrier.

12. The construction panel of claim 11, wherein a position of the at least one machinable portion is marked on the construction panel.

13. The construction panel of claim 12, wherein a marking of a position of the at least one machinable portion is on a removable protective film.

14. The construction panel of claim 13, wherein a position of the integrated transponder is also marked on the removable protective film.

15. The construction panel of claim 1, wherein a wall hanger is integrated in the construction panel.

16. The construction panel of claim 15, wherein the wall hanger is installed on the fitting.

17. The construction panel of claim 1, wherein the end face having the recess comprises a narrow side coating, which indirectly or directly conceals at least parts of an end face of the housing outer wall of the fitting.

18. The construction panel of claim 17, wherein the narrow side coating extends in one part or multiple parts over an entire length of the end face.

19. The construction panel of claim 18, wherein the narrow side coating is an edge band.

20. The construction panel of claim 1, wherein the narrow side coating is a cover plate or cover strip.

21. The construction panel of claim 2, wherein the lever mechanism, in a retracted state, is located between the two laterally arranged cover layers.

22. A method for producing a construction panel, the method comprising:

providing a plate-shaped core, which comprises chipboard, medium-density fiberboard, or high-density fiberboard;

introducing a recess into the plate-shaped core, the recess extending at least along a portion of a first end face of the plate-shaped core, wherein at least one protruding machinable portion remains on at least one further end face of the plate-shaped core outside the recess;

applying at least one lateral cover layer to the plate-shaped core before or after the introduction of the recess; and arranging a fitting in the recess before or after applying the at least one lateral cover layer, wherein the fitting is a flap fitting comprising a lever mechanism configured to guide a movable furniture part, wherein the recess is open toward a first end face of the plate-shaped core, so that the lever mechanism of the fitting can plunge into the construction panel, and wherein the construction panel is a side wall or intermediate wall of the furniture body.

23. The method of claim 22, further comprising:

marking the at least one protruding machinable portion so it is externally recognizable.

24. The method of claim 23, wherein a protective film, on which at least one machinable portion is marked, is applied to the at least one lateral cover layer.

25. The method of claim 22, further comprising:

applying a narrow side coating to the first end face before the insertion of the fitting into the recess, the narrow side coating concealing at least parts of the first end face of a housing wall of the fitting.

26. The method of claim 22, further comprising:

applying a narrow side coating to the first end face after the insertion of the fitting into the recess, the narrow side coating concealing at least parts of the end face of a housing wall of the fitting.

27. The method of claim 22, further comprising:

cutting to a length of the construction panel, the at least one protruding machinable portion.

28. The construction panel of claim 1, wherein the plate-shaped core is formed as a composite material including at least the chipboard, medium-density fiberboard, or high-density fiberboard.

29. The construction panel of claim 28, wherein the plate-shaped core has an edge region and an inner region, wherein the edge regions are formed by the chipboard, medium-density fiberboard, or high-density fiberboard and the inner region is formed by a honeycomb structure material.

30. The construction panel of claim 29, wherein the recess has an upper portion and a lower portion, wherein, in a lateral direction across the construction panel, the lower portion is less deep than the upper portion, and wherein, in the lateral direction across the construction panel, the inner region formed by the honeycomb structure material is arranged adjacent to a lateral side of the lower portion of the recess.

31. The construction panel of claim 29, wherein the honeycomb structure material is a cardboard material.

* * * * *